US011077470B2

(12) United States Patent
Torang

(10) Patent No.: US 11,077,470 B2
(45) Date of Patent: Aug. 3, 2021

(54) SORTING SYSTEM WITH MULTIPLE SORTING DEVICES

(71) Applicant: Envac Optibag AB, Mjolby (SE)

(72) Inventor: Christian Torang, Linkoping (SE)

(73) Assignee: Envac Optibag AB, Mjolby (SE)

( * ) Notice: Subject to any disclaimer, the term of this patent is extended or adjusted under 35 U.S.C. 154(b) by 168 days.

(21) Appl. No.: 15/536,643

(22) PCT Filed: Dec. 16, 2015

(86) PCT No.: PCT/EP2015/080042
§ 371 (c)(1),
(2) Date: Jun. 15, 2017

(87) PCT Pub. No.: WO2016/097014
PCT Pub. Date: Jun. 23, 2016

(65) Prior Publication Data

US 2019/0091730 A1 Mar. 28, 2019

(30) Foreign Application Priority Data

Dec. 17, 2014 (SE) ..... 1451571

(51) Int. Cl.
*B07C 5/36* (2006.01)
*B07C 5/34* (2006.01)

(52) U.S. Cl.
CPC ..... *B07C 5/36* (2013.01); *B07C 5/3412* (2013.01); *B07C 2501/0054* (2013.01)

(58) Field of Classification Search
CPC ..... B07C 5/34; B07C 5/3412; B07C 5/342; B07C 5/36; B07C 5/362;
(Continued)

(56) References Cited

U.S. PATENT DOCUMENTS 1,878,315 A * 9/1932 Phelps ..... B07B 13/05 209/654
5,275,295 A * 1/1994 Eisenlohr ..... B07C 5/3412 209/536

(Continued)

FOREIGN PATENT DOCUMENTS

CN 2561523 Y 8/2002
CN 1443107 A1 9/2003

(Continued)

OTHER PUBLICATIONS

Communication Pursuant to Article 94(3) EPC issued in counterpart Swedish Application 15813043.5 dated Jun. 14, 2018 (three (3) pages).

(Continued)

*Primary Examiner* — Joseph C Rodriguez
(74) *Attorney, Agent, or Firm* — Olive Law Group, PLLC

(57) ABSTRACT

A system for sorting waste objects is disclosed. According to an aspect of the present disclosure, the system includes at least one sorting unit, in which the sorting unit is connected to at least one sensor system that identifies the waste objects. The sensor system is arranged to detect one or more waste object characteristics and is also arranged to provide a control system with a signal when a waste object of a desired type is detected. The system also includes at least one sorting conveyor that conveys the waste objects to the sorting unit in which the sorting unit is provided with two or more sorting devices that sort the waste objects. The sorting devices of the present disclosure are arranged to receive at least one signal from the control system in response to a waste object of a desired type being detected by the sensor system.

7 Claims, 6 Drawing Sheets

(58) Field of Classification Search
CPC .... B07C 2301/0016; B07C 2501/0054; B07C 5/367; B07C 5/368
See application file for complete search history.

(56) References Cited

U.S. PATENT DOCUMENTS

| | | | | |
|---|---|---|---|---|
| 9,120,131 | B2 * | 9/2015 | Sundholm | B07C 5/3412 |
| 9,405,992 | B2 * | 8/2016 | Badholm | B07C 5/3412 |
| 9,707,595 | B2 * | 7/2017 | Ripley | B65G 43/08 |
| 9,790,024 | B2 * | 10/2017 | Sundholm | B07C 5/3412 |
| 2003/0183705 | A1 | 10/2003 | Christiani et al. | |
| 2009/0306816 | A1 * | 12/2009 | Champel | B07C 5/34 700/223 |
| 2014/0050397 | A1 | 2/2014 | Badholm et al. | |
| 2017/0225199 | A1 * | 8/2017 | Koistinen | B65F 1/0006 |

FOREIGN PATENT DOCUMENTS

| | | | |
|---|---|---|---|
| CN | 101489683 | A2 | 7/2009 |
| CN | 102574161 | A | 7/2012 |
| DE | 9116904 | U1 | 10/1994 |
| EP | 0554207 | A2 | 8/1993 |
| EP | 0554207 | A3 | 8/1994 |
| EP | 583618 | B1 | 12/1995 |
| EP | 1854555 | B1 | 12/2009 |
| EP | 2064004 | B1 | 1/2011 |
| EP | 2694223 | | 9/2014 |
| EP | 1855964 | B1 | 2/2016 |
| FR | 2905613 | A1 | 3/2008 |
| WO | 9011142 | A1 | 10/1990 |
| WO | 9532062 | A1 | 11/1995 |
| WO | 9622512 | A1 | 7/1996 |
| WO | 03039773 | A1 | 5/2003 |
| WO | 2004050264 | A1 | 6/2004 |
| WO | 2005/084827 | A1 | 9/2005 |
| WO | 2006096101 | A1 | 9/2006 |
| WO | 2007/135280 | A2 | 11/2007 |
| WO | 2008031931 | A1 | 3/2008 |
| WO | 2011/029991 | A2 | 3/2011 |
| WO | 2011029991 | A2 | 3/2011 |
| WO | 2012134389 | A1 | 10/2012 |

OTHER PUBLICATIONS

International Search Report and Written Opinion for PCT/EP2015/080042 dated Mar. 7, 2016.

Australian Patent Application issued in counterpart AU Application No. 2013257403 A1 dated Nov. 11, 2013 (thirty-four (24) pages).

International Preliminary Report on Patentability dated Jun. 20, 2017 from related International Application No. PCT/EP2015/080042.

Search Report from European Patent Office for corresponding European Patent Application No. 15 813 043.5, dated: Apr. 14, 2020.

Communication pursuant to Article 94(3) EPC from European Patent Office in corresponding European Patent Application No. 15 813 043.5; dated Jun. 18, 2019.

SpiralTrans brochure material and translations. Pub Date: Not Available.

* cited by examiner

SORTING SYSTEM WITH MULTIPLE SORTING DEVICES

CROSS REFERENCE TO RELATED APPLICATIONS

This application is a 35 USC 371 application of International PCT Patent Application No. PCT/EP2015/080042, filed on Dec. 16, 2015, which claims priority to Sweden Patent Application No. 1451571-2, filed on Dec. 17, 2014; the contents of which are hereby incorporated by reference herein in their entireties.

TECHNICAL FIELD

The present document relates to a sorting system and a sorting method for sorting waste objects. More specifically the present document relates to sorting units comprising multiple sorting devices.

BACKGROUND

In recent years an automated sorting of domestic waste, sorted at source, into different fractions has become more and more important in order to increase the efficiency of the waste handling facilities and in order to be able to take care of the ever growing amounts of waste produced by the households.

There are a number of different methods and systems available today to perform this type of sorting.

WO95/32062 discloses an arrangement for sorting differently coloured waste sacks which occur in random distributions and contain different types of waste sorted at source. This arrangement comprises sorting stations, which by means of a colour analysis as disclosed in WO9622512 identify and then separate waste sacks of a predetermined colour, which are conveyed on a conveyor belt.

In EP 1 583 618 the refuse sacks are provided with a means of identification, in this case the entire bag is provided with a specific colour, and the sorting is performed at least one sorting station, which is able to identify at least two means of identification, this method and arrangement thus further enhances the accuracy of the sorting.

In WO90/11142 an apparatus and method for sorting waste is disclosed. The waste is provided in coloured bags and sorted by sorting means after being detected by a detection device.

In EP1854555B1 waste bags are transported in screw conveyors in order to separate the waste bags. The bags are identified based on e.g. colour and separated from the others by opening a bottom plate.

In recent years environmental concerns have also moved the waste sorting to include more fractions to be sorted at source, i.e. food waste, paper, plastics etc. is to be sorted in the homes of the users.

As both the amounts of domestic waste and the fractions of waste to be sorted continues to increase, there is a need to not only provide for a more efficient sorting, in terms of speed and accuracy, in the sorting facilities, but also a need to keep the size of the facilities at a minimum to reduce the costs of buildings, equipment etc.

SUMMARY

It is an object of the present disclosure, to provide an improved sorting system, which eliminates or alleviates at least some of the disadvantages of the prior art sorting systems and facilities.

More specific objects include providing a sorting system and a method for sorting waste objects which allows for more compact and efficient waste sorting facilities.

The object is wholly or partially achieved by a sorting system and a method for sorting waste objects according to the appended independent claims. Embodiments are set forth in the appended dependent claims, and in the following description and drawings.

According to a first aspect, there is provided a system for sorting waste objects, wherein the waste object is provided with means for identification thereof, wherein the system comprises, at least one sorting unit, wherein the sorting unit is connected to at least one sensor system for identifying said waste object or said means for identification, said sensor system being arranged to detect one or more means for identification and arranged to provide a control system with a signal when a waste object of a desired type is detected. The sorting system comprises at least one sorting conveyor for conveying said waste objects to said sorting unit. The said sorting unit is provided with two or more sorting devices for sorting the waste objects, wherein said sorting devices are arranged to receive at least one signal from said control system in response to a waste object of a desired type being detected by the sensor system.

By "sorting the waste objects" is meant that the sorting devices are arranged to move the waste objects from the sorting conveyor and either into a sorting container or e.g. onto another conveyor.

By "being connected to" means that a sensor system in some way controls one or more sorting units.

This innovative system, with one sensor system controlling multiple sorting devices for sorting waste objects, provides for a way of providing a shorter and more compact sorting facility and for a higher throughput of waste objects and material.

According to one embodiment said sorting devices may be arranged to be individually controllable.

This allows for the sensor system being more flexible, since different types of waste objects may have different types of demands for the subsequent treatment in the sorting process. This means that when a waste object of a desired type has been detected by the sensor system and this has generated a signal to the control system, the control system may provide the sorting devices with the same or different signals, e.g. it may provide only one of the sorting devices with a signal to remove the waste object or both. This also means that if a first sorting devices is activated, i.e. has received a signal from the control system to remove an object from the conveyor, and a new object of the desired type passes the sensor system, the control system may provide a signal to a second sorting device to become activated, i.e. to remove waste from the conveyor. This type of control function may therefore further enhance the sorting capacity of the sorting facility. This may also mean that the sorting devices are physically remote from the sensor system, such that one sensor system may be arranged to control the function of several sorting units having multiple sorting devices. It is further possible that different waste objects may be treated differently in that they may be removed by different types of sorting devices.

According to one embodiment the sorting unit may be provided with two sorting devices. The waste object may be a container or bag, and wherein said container or bag is provided with means for identification.

This provides for a way of the user, or households to sort the waste at source and place the waste in a container or bag, which can subsequently be sorted at a sorting facility.

The means for identification may comprise any one of colour, pattern or RFID-identification, or a combination thereof.

This provides for a system which can detect and sort many different types of waste material, which may have been sorted at source by the user. Such means for identification and containers are for instance described in EP1855964 and EP2694223.

According to one embodiment the sensor system may comprise sensors arranged to be able to detect at least one of said means for identification or a combination thereof.

This means that the sensor system may comprises colour detection sensors, such as cameras, and also sensors for identifying pattern arranged on the containers. Such sensors for detecting pattern may be cameras, but may also be other types of sensors. The sensor system may also comprise sensors for detecting RFID signals. In an alternative the sensor system may comprise a combination of one or more of these types of sensors, which may also allow for a more accurate sorting to take place.

According to one embodiment the sorting device may comprise a blade.

According to a second aspect there is provided a method for sorting waste objects in a sorting system according to the first aspect, wherein the waste objects are provided with means for identification, and wherein the method comprises the steps of: providing said waste objects on at least one sorting conveyor, detecting said waste object or means for identification through at least one sensor system, arranged in connection with at least one sorting unit, providing a control system with a signal when a desired object or object provided with desired means for identification is detected by said sensor system. The method further comprises the step of providing two or more sorting devices with an activation signal by said control system, in response to said desired object or object provided with desired means for identification being detected.

The sorting system may comprise several sorting conveyors, for instance in parallel or in series. The sorting system according to the method may comprise one sensor system controlling multiple sorting units and/or sorting devices. The sorting system may comprise multiple sorting units, e.g. one for each means of identification. The sorting units may be arranged in parallel or in series.

By "activation signal" is meant that the sorting device is provided with a signal or some other type of input to react or act on a specific waste object, i.e. to remove the waste object from the sorting conveyor.

According to one embodiment the sorting device may comprise a blade.

According to one alternative embodiment the sorting devices may be individually controllable by said control system.

BRIEF DESCRIPTION OF THE DRAWINGS

Embodiments of the present solution will now be described, by way of example, with reference to the accompanying schematic drawings.

DESCRIPTION OF EMBODIMENTS

In a central waste sorting facility, waste objects, such as containers or bags comprising different types of waste fractions, are collected to be sorted in an automated process in different material fractions.

The waste objects may be provided with means for identification corresponding to the waste fraction contained therein.

In the alternative the waste object may be sorted based on material recognition sensors, i.e. recognition of the waste object itself rather than on means of identification provided thereon. Such sorting is disclosed in for instance EP2064004 B1.

The means for identification may be a specific colour of the bag, a specific pattern arranged on the bag or an RFID-tag arranged on the bag, or any other means for identification suitable for waste sorting. Different means may also be combined.

Usually the waste objects are delivered to the waste sorting facility by a refuse collection vehicle or pneumatic transport system, where a mixture of different types of waste objects are is placed in a receiving bunker. The bags or containers are moved from the receiving bunker into the sorting facility be means of conveyors.

The conveyors may be e.g. conventional belt conveyors or rotating shaft (screw) conveyors. Often the bags are transported through a series of conveyors in order to separate the bags from each other to make the detection and sorting of each individual object or bag easier. The speed of the conveyors is often increased gradually.

Figure 1A:
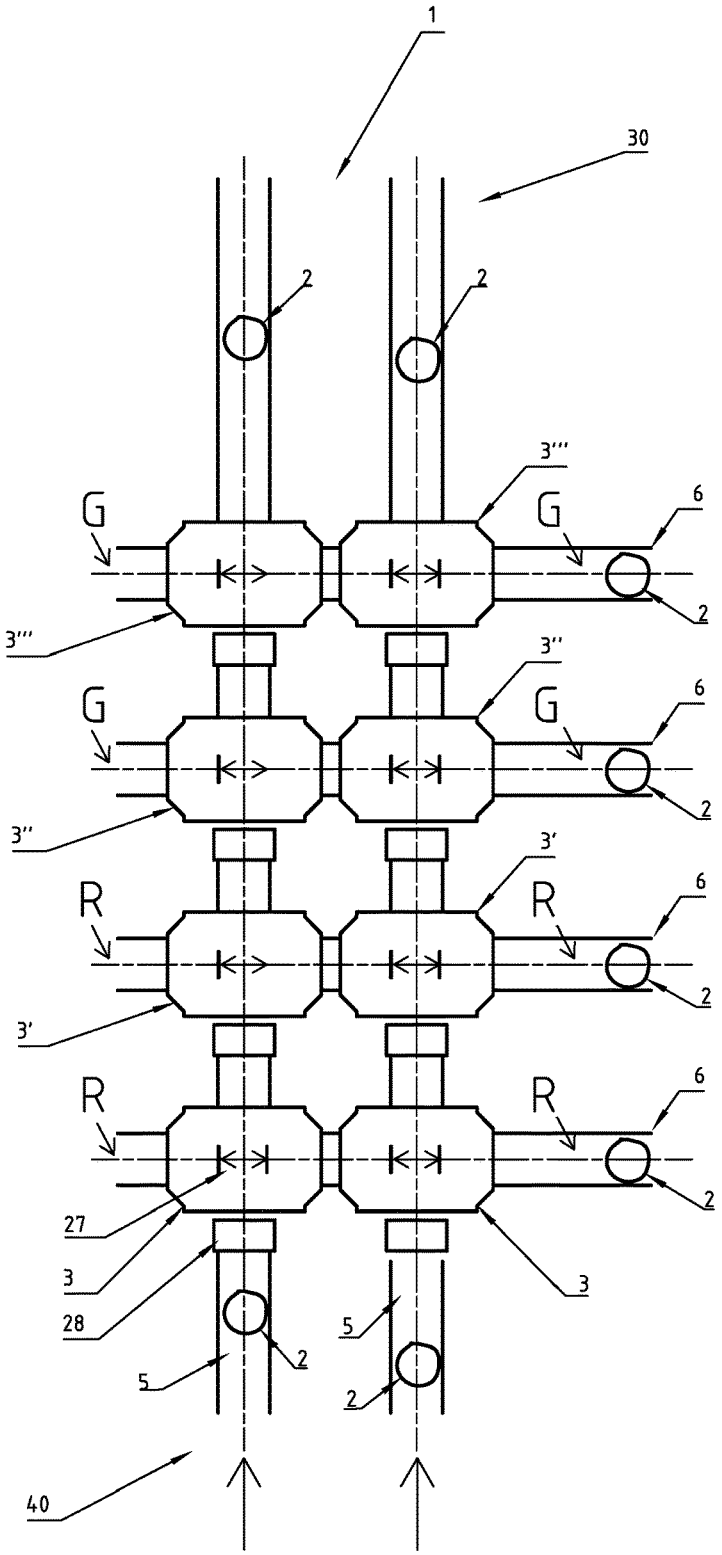
FIG. 1*a* is a schematic top view of a prior art sorting system
Figure 1B:
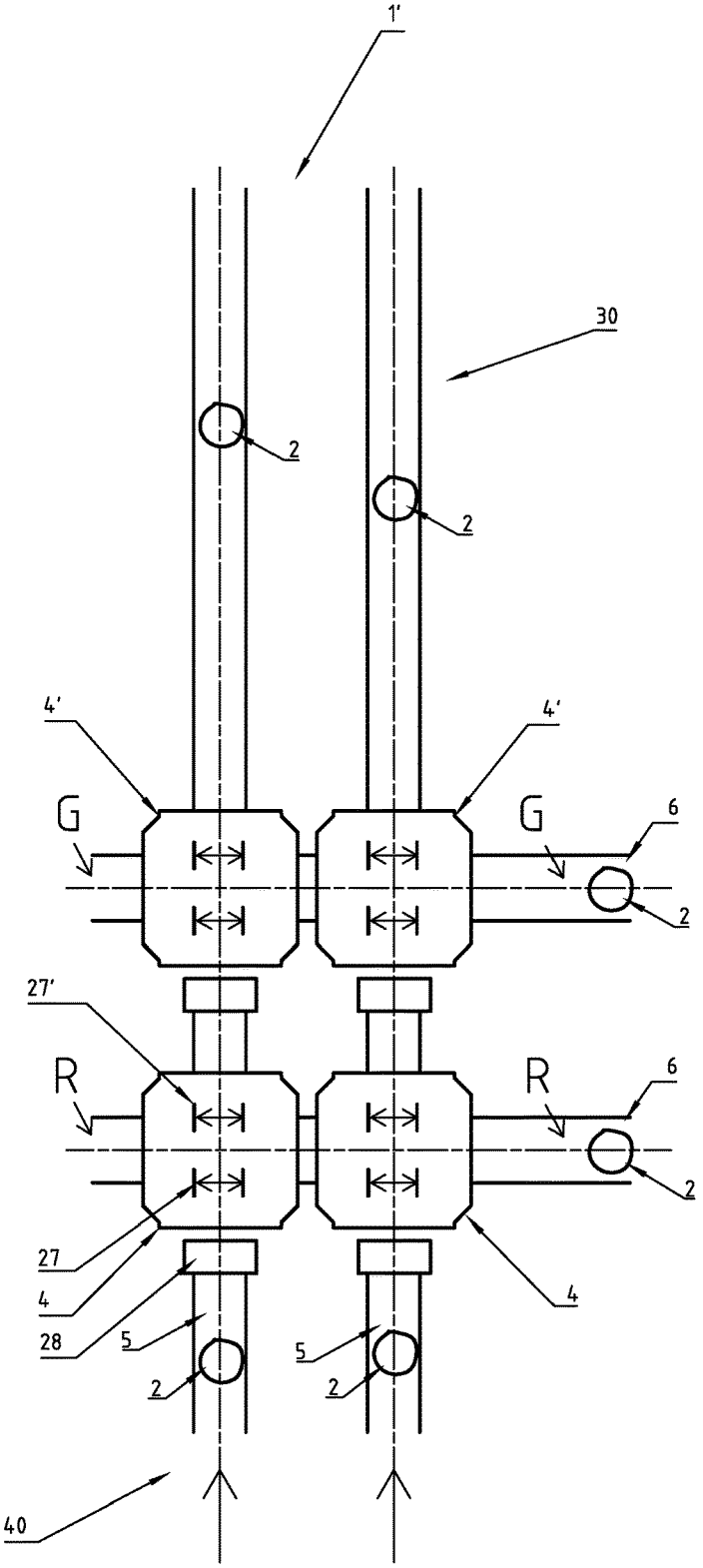

The objects 2 may be transported to a sorting conveyor 5 which is illustrated in FIGS. 1*a* and 1*b*. FIG. 1*a* illustrates a conventional system for sorting two different fractions, G and R. The waste objects 2 are transported into a first sorting unit 3, and each sorting unit 3 is provided with only one sorting device 27. In FIG. 1*b* each sorting unit 4, 4' is provided with two (or more) sorting devices 27. In the sorting system of FIG. 1*a* the waste objects or bags provided with identification means R are sorted in the two first consecutive sorting units 3 and 3', and the bags with identification means G are sorted in the second two consecutive sorting units 3" and 3''' and moved onto a second conveyor 6. In the sorting system 1' illustrated in FIG. 1*b* the objects provided with identification means R are sorted in the first sorting unit 4 and the objects provided with identification means G are sorted in the second sorting unit 4'. It is possible to sort the same amount of objects in the sorting system as disclosed in FIG. 1*b* as compared to the system in FIG. 1*a*, but the system takes up far less space and is also more efficient as will be described below.

Figure 2A:
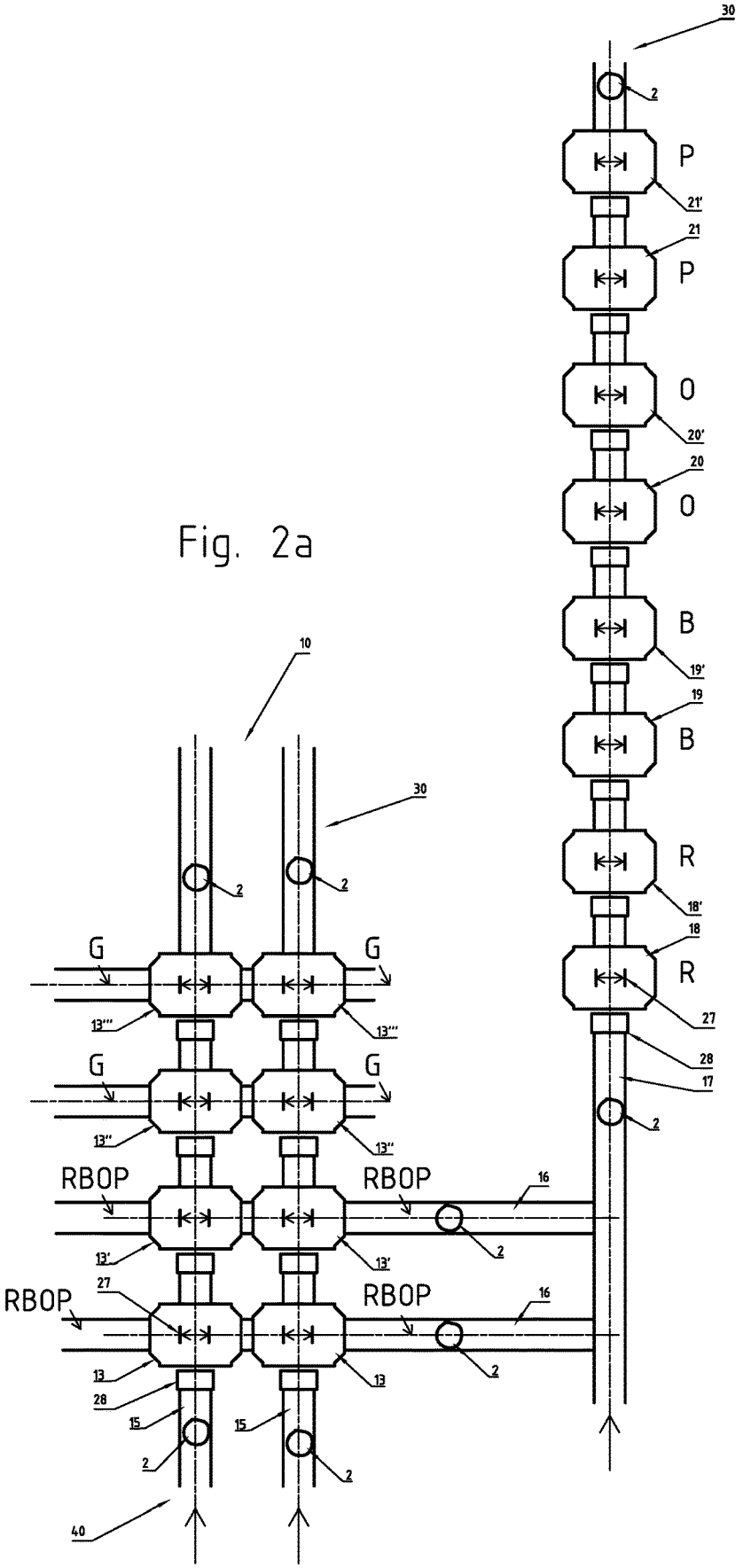
FIG. 2*a* is a schematic top view of a prior art sorting system.
Figure 2B:
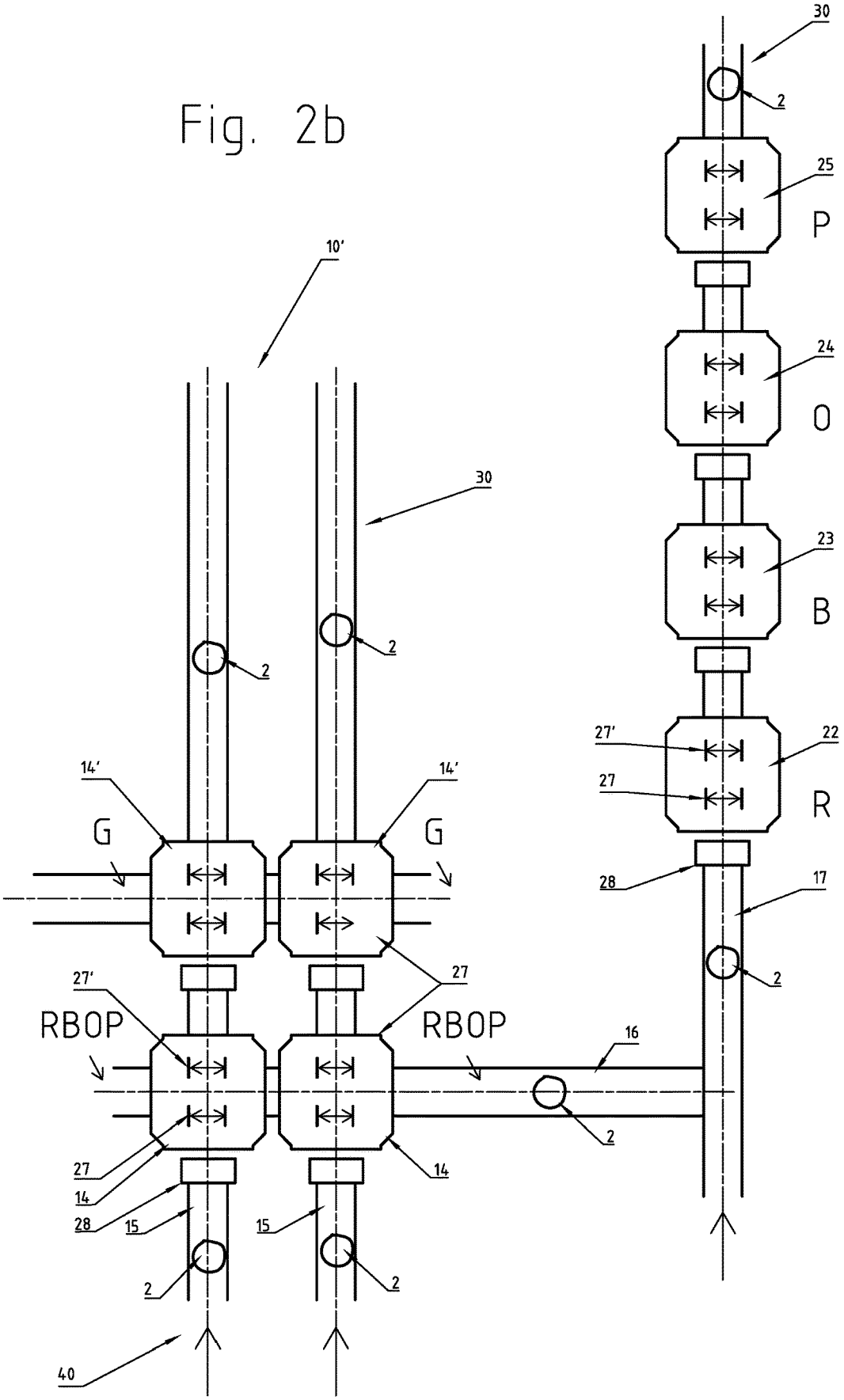
FIG. 2*b* is a schematic top view of a sorting system according to the present disclosure.

FIGS. 2*a* and 2*b* illustrate a sorting system 10 and 10' for sorting objects having different identifications means RBOP in a first sorting unit. This means that more than one fraction is sorted in the first sorting unit 13 and 14.

FIG. 2*a* each illustrates a conventional sorting unit 10 which is provided with one sorting device and also in a second sorting unit 13' objects having different identification means are RBOP sorted. These objects RBOP are conveyed onto a transport conveyor 16 onto a second sorting conveyor 17, for a new sorting in the consecutively arranged sorting units 18, 18', 19, 19', 20, 20', 21, 21' for sorting of the R, B, O and P fractions in respective two (or more) sorting units.

The object G not being sorted in the first two sorting units 13, 13' is sorted in the two (or more) consecutive second sorting units 13", 13'".

In FIG. 2*b* each sorting unit 14, 14', 22, 23, 24, 25 is provided with two sorting devices 27. In the first sorting unit 14 objects having different identifications means RBOP are sorted onto a transport conveyor 16 and further onto a second sorting conveyor 17 along which a series of third sorting units 22, 23, 24, 25 are arranged. In each of these third sorting units it is possible to sort one fraction R, B, O, P respectively. The fraction G not being sorted in the first sorting unit 14 is sorted in the second sorting unit 14' downstream the first sorting conveyor 15. FIG. 2*b* illustrate that a sorting facility can be more compact, and which will be described below more efficient in sorting waste objects.

Figure 3:
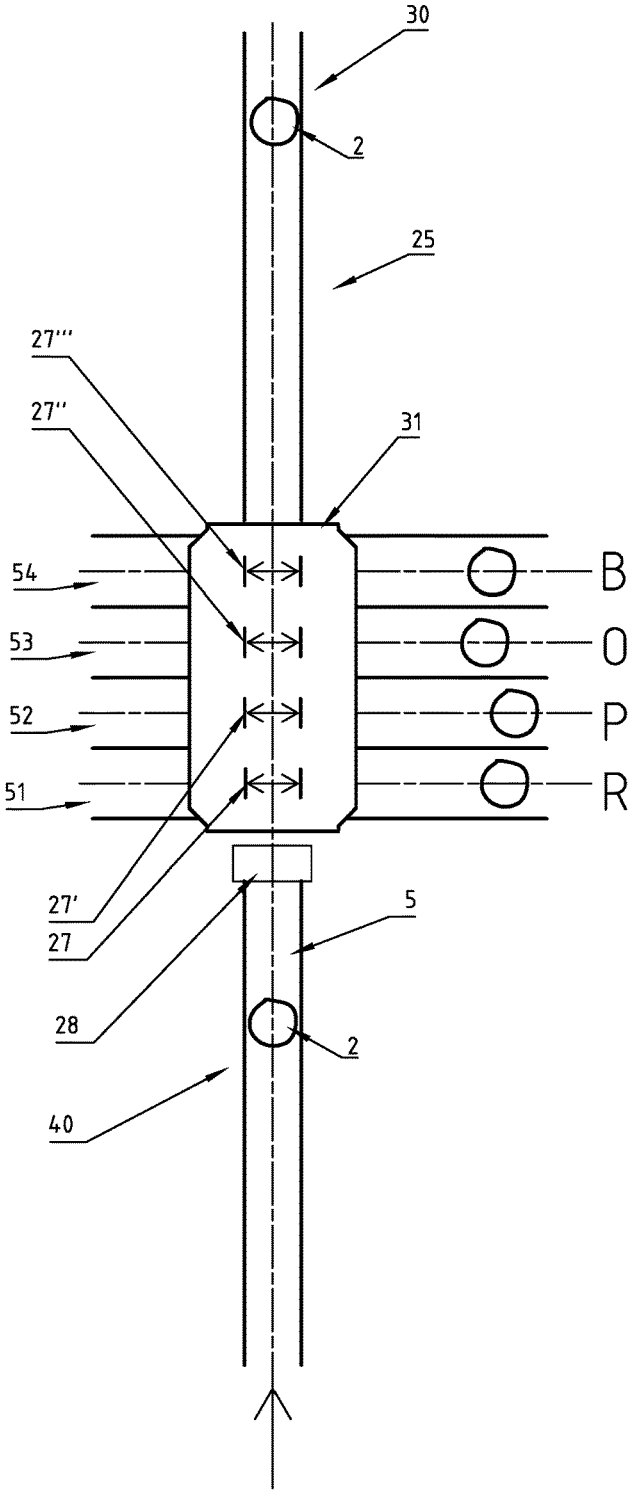
FIG. 3 is a schematic top view of a sorting unit.

FIG. 3 illustrates a sorting unit 10' having a sensor system 35 and two sorting devices 40.

In each of the sorting units described above the sorting unit is provided with a sensor system 35. The sensor system is arranged to detect identification means provided on the waste objects or as described above the material of the waste object itself. Different types of sensors have been described in the prior art, such as cameras for colour and pattern recognition or RFID-readers for RFID-tags. The sensor system is arranged to provide a signal to a control system, which, in turn, controls the sorting devices.

When a waste object 2 with a desired identification means is detected by the sensor system, e.g. as in FIG. 1*b* when a waste bag with identification means R passes through sorting unit 4, a signal is sent to a control system (not shown). The control system then provides the sorting device with a signal for sorting the waste object R. By "sorting" may be meant that the object is either transferred to another conveyor for a second sorting, or into a sorting container specific for that waste fraction. Fractions not sorted in the sorting units may either be transferred to a sorting container or transported back into the sorting facility or system for a renewed sorting, which is illustrated in FIGS. 1*a* and 1*b* and FIGS. 2*a* and 2*b* where a waste object 2 is transported downstream 30 of either one of the sorting units.

As a waste object of a specific waste fraction passes by the sensor system the present parameters or identification means (i.e. colour, pattern, RFID etc.) are detected or identified and compared to predetermined requirements set in a control system. The parameters are then compared, individually or jointly to these predetermined requirements. If the sensor system detects a waste fraction which fulfils the predetermined requirements for that sorting unit, i.e. is approved or desired for that sorting unit, the sensor system sends a signal to the control system. The waste objects may have different predetermined requirements depending on the fraction they represent and may be treated differently in the subsequent steps of the sorting unit.

The control system provides the control devices with a signal depending on the requirements of the present fraction. If the sensor system detects a desired object the control system may provide a signal to the sorting devices to activate the device or devices, i.e. an activation signal. By "activate or activation" is meant that the sorting device is made to act upon the signal, e.g. to remove the object from the conveyor.

According to one embodiment the control system may be arranged to control each of the sorting devices individually. This means that the control system may provide only one of the two (or more) sorting devices with an activation signal, depending on the predetermined requirements of the waste fraction or e.g. on the position of the waste object on the conveyor. This allows for a greater flexibility and an improved sorting accuracy of the system. This also means that while one sorting device is activated, the second (or further) sorting device(s) may be activated independently as a response to a desired waste fraction being detected by the sensor system. The control system may also send an activation signal to both (or more) sorting devices simultaneously.

According to one alternative embodiment the control system may also send a signal to a sorting device of another sorting unit further downstream 30 the sorting system or sorting line. For instance, in FIG. 1*b* if a waste fraction G which is approved for sorting unit 4' is detected in sorting unit 4 the control system may send an activation signal to the sorting devices of sorting unit 4'.

According to one embodiment, as illustrated by FIG. 3 the sorting system may even comprise only one sensor system 28, e.g. arranged at the beginning 40 of a sorting conveyor 5, or in the proximity of the sorting devices, and the subsequent sorting unit 31, may then comprise two or more sorting devices 27, 27', 27", 27'", which are then controlled by that one sensor system 28, according to the same definitions and principles as set out above. In FIG. 3 the waste fractions 2 are sorted by the sorting devices onto conveyors 51, 52, 53, 54, or directly into sorting containers. FIG. 3 thus illustrates that one sensor system 28 is arranged to control multiple sorting devices 27 within one sorting unit 31.

In the sorting unit as illustrated by FIG. 3 the respective sorting devices may also be arranged to remove more than one fraction 2, B, O, P, R. For instance it could be possible to have sorting device 27 remove two fractions R and P, sorting device 27' two fractions B and O etc. in any possible combination or number of fractions.

This may be a way to reduce the cost of the facility even further. The control system then regulates which of the sorting devices in the respective sorting units that should be activated.

Figure 4:
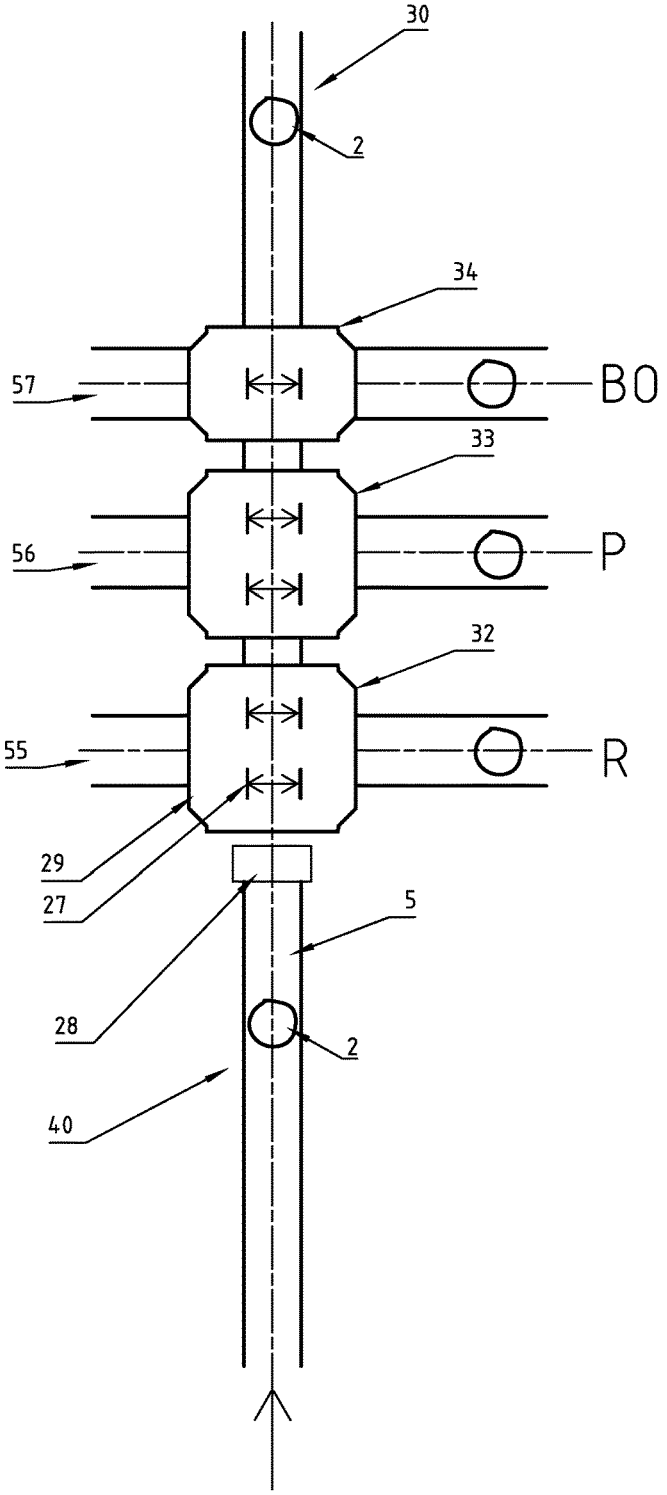
FIG. 4 is a schematic top view of a sorting unit.

In FIG. 4 yet another embodiment is illustrated in which one sensor system 28 detects and controls two or more separate sorting units 32, 33, 34. The respective sorting units may comprise one or more sorting devices 27. The waste fractions 2, B, O, P, R may for instance be removed onto conveyors 56, 57, 58 or directly into sorting containers.

In all of the above described sorting operations it is possible to allow the sorted waste fractions to move on to a new identification and sorting, either by bringing them back into the inlet, or by moving them to another sorting unit.

According to one embodiment the sorting device 27 may be a pusher type, i.e. comprise a blade, scraper or paddle which moves over the conveyor belt to push or scrape the waste object from the conveyor. According to another embodiment the sorting device 27 may comprise a compressed air device, where air is used to push the waste object off of the conveyor. According to yet an alternative the sorting device may be a robot device, which may either push or lift the waste object off of the conveyor. According to another alternative the sorting device may comprise a suction device. According to yet another alternative the sorting device may comprise e.g. an openable hatch or some type of opening at the bottom of the conveyor. Other types of sorting devices known to the skilled person may also be used in the present invention.

According to one embodiment the sensor system may detect where on the conveyor surface the waste object is located. This means that if the waste object, or bag is located to the left and the sorting device is arranged to the right, it is possible to provide the sorting device with a signal such that it begins the sorting movement over the conveyor earlier than it would if the waste object was located at the right or middle of the conveyor.

According to an alternative system further may comprise a height detector to detect that it in fact is a bag or container that is conveyed on the conveyor. The height detector may be a photo sensor or laser or even a camera. This provides for a way of not providing the sorting device with a signal if there is no waste object to remove, i.e. that the sensor system has detected something other than a bag or container being conveyed on the container.

The invention claimed is:

1. A system for sorting waste objects, the system comprises:

at least one first sorting unit including a housing, wherein the first sorting unit is connected to at least one sensor system that identifies said waste objects, wherein the waste object is a container or bag, the at least one sensor system being arranged to detect at least two waste object characteristics and arranged to provide a control system that generates a signal in response to detection of a container or bag having one of the at least two waste object characteristics within the housing and indicative of the detected one of the at least two waste object characteristics, at least one first sorting conveyor that conveys said waste objects to said first sorting unit along a first substantially linear pathway, wherein said first sorting unit is provided with two or more sorting devices within the housing, the sorting devices being a pusher type comprising one of a blade, scraper, or paddle which move over the sorting conveyor, the sorting devices being positioned along the linear pathway, wherein said sorting devices are arranged to receive the signal from said control system, wherein the at least one sensor system is arranged to individually control the at least two sorting devices within said first sorting unit, and wherein the at least one sensor system is arranged to control activation of one of the at least sorting devices based on the detected one of the at least two waste object characteristics for moving an associated container or bag from the at least one first sorting conveyor, and at least one second sorting conveyor that conveys waste objects of a second desired type from said first sorting unit to a second sorting unit for processing.

2. The system as claimed in claim 1, wherein the at least one first sorting unit consists of two sorting devices.

3. The system as claimed in claim 1, wherein said container or bag is provided with said one or more waste object characteristics.

4. The system as claimed in claim 3, wherein the one or more waste object characteristics comprises any one of color, pattern or RFID-identification, or a combination thereof.

5. The system as claimed in claim 4, wherein the at least one sensor system comprises sensors arranged to detect said one or more waste object characteristics.

6. A method for sorting waste objects, the method comprising:

providing said waste objects on at least one sorting conveyor that conveys said waste objects to at least one first sorting unit along a first substantially linear pathway, wherein the at least one first sorting unit includes a housing, wherein the waste object is a container or bag, wherein said objects contain at least two waste object characteristics;

detecting said at least two waste object characteristics of said waste object through at least one sensor system, arranged in connection with the at least one first sorting unit;

providing a control system that generates a signal in response to detection of a container or bag having one of the at least two waste object characteristics within the housing and indicative of the detected one of the at least two waste object characteristics;

providing two or more sorting devices positioned along the linear pathway and within the housing of the first sorting unit, the sorting devices being a pusher type comprising one of a blade, scraper, or paddle which move over the sorting conveyor, the sorting devices being activated by receipt of the signal by said control system, in response to said desired first object being detected, wherein the at least one sensor system is arranged to individually control the at least two sorting devices within one sorting unit;

controlling, by the control system, activation of one of the at least sorting devices based on the detected one of the at least two waste object characteristics for moving an associated container or bag from the at least one first sorting conveyor; and providing at least one second sorting conveyor that conveys waste objects of a second desired type from the first sorting unit to a second sorting unit for processing.

7. The method as claimed in claim 6, wherein the at least one sensor system comprises sensors arranged to detect said at least two waste object characteristics.

* * * * *